US008757269B2

(12) United States Patent
Tabor et al.

(10) Patent No.: US 8,757,269 B2
(45) Date of Patent: Jun. 24, 2014

(54) CLAMP FOR A WELL TUBULAR

(75) Inventors: William J. Tabor, Magnolia, TX (US); Huey J. Kliebert, Jr., The Woodlands, TX (US); Scott A. Marshall, Houston, TX (US); Benton John Vicknair, Thibodaux, LA (US)

(73) Assignee: Oceaneering International, Inc., Houston, TX (US)

( * ) Notice: Subject to any disclaimer, the term of this patent is extended or adjusted under 35 U.S.C. 154(b) by 464 days.

(21) Appl. No.: 12/841,628

(22) Filed: Jul. 22, 2010

(65) Prior Publication Data

US 2012/0018164 A1 Jan. 26, 2012

(51) Int. Cl.
*E21B 7/12* (2006.01)

(52) U.S. Cl.
USPC ..... 166/340; 166/341; 166/342; 166/343; 166/345

(58) Field of Classification Search
USPC ..... 166/340, 341, 342, 343, 345, 55.2, 55.6
See application file for complete search history.

(56) References Cited

U.S. PATENT DOCUMENTS

| | | | | | |
|---|---|---|---|---|---|
| 3,299,954 | A * | 1/1967 | Williams et al. | ..... | 166/298 |
| 3,461,958 | A * | 8/1969 | Brown | ..... | 166/361 |
| 3,557,564 | A * | 1/1971 | Hauber | ..... | 5/169 |
| 3,748,702 | A * | 7/1973 | Brown | ..... | 188/67 |
| 3,894,326 | A * | 7/1975 | Merriman | ..... | 29/281.5 |
| 3,983,936 | A * | 10/1976 | Kennard et al. | ..... | 166/361 |
| 4,209,066 | A * | 6/1980 | Watson | ..... | 166/377 |
| 4,249,610 | A * | 2/1981 | Loland | ..... | 166/360 |
| 4,269,277 | A * | 5/1981 | Baugh | ..... | 173/149 |
| 4,528,910 | A * | 7/1985 | Blanc et al. | ..... | 102/306 |
| 4,703,802 | A * | 11/1987 | Bryan et al. | ..... | 166/298 |
| 4,844,660 | A * | 7/1989 | Ortemond | ..... | 405/224 |
| 5,092,711 | A * | 3/1992 | Langner | ..... | 405/169 |
| 5,238,069 | A * | 8/1993 | Schaefer et al. | ..... | 166/361 |
| 5,318,115 | A * | 6/1994 | Rouse | ..... | 166/55.7 |
| 5,386,746 | A * | 2/1995 | Hauk | ..... | 81/57.34 |
| 5,467,833 | A * | 11/1995 | Crain | ..... | 175/52 |
| 5,507,596 | A * | 4/1996 | Bostelman et al. | ..... | 405/191 |
| 5,848,647 | A * | 12/1998 | Webre et al. | ..... | 166/379 |
| 6,192,981 | B1 * | 2/2001 | Boquet et al. | ..... | 166/75.13 |
| 6,357,528 | B1 * | 3/2002 | Davis et al. | ..... | 166/339 |
| 6,640,939 | B2 * | 11/2003 | Buck | ..... | 188/67 |
| 6,763,753 | B1 * | 7/2004 | Brumley et al. | ..... | 83/639.1 |
| 6,845,814 | B2 * | 1/2005 | Mason et al. | ..... | 166/75.14 |
| 7,090,019 | B2 * | 8/2006 | Barrow et al. | ..... | 166/361 |
| 7,222,677 | B2 * | 5/2007 | Webre et al. | ..... | 166/379 |
| 7,306,404 | B2 * | 12/2007 | Torgersen | ..... | 405/224.4 |
| 7,681,631 | B2 * | 3/2010 | Thomas et al. | ..... | 166/77.1 |
| 7,757,754 | B2 * | 7/2010 | McKay | ..... | 166/55.7 |
| 7,823,632 | B2 * | 11/2010 | McAfee et al. | ..... | 166/55.7 |
| 8,020,627 | B2 * | 9/2011 | Shahin et al. | ..... | 166/382 |
| 8,056,633 | B2 * | 11/2011 | Barra et al. | ..... | 166/298 |
| 8,291,977 | B2 * | 10/2012 | Mire | ..... | 166/298 |

(Continued)

*Primary Examiner* — Matthew Buck
*Assistant Examiner* — Aaron Lembo
(74) *Attorney, Agent, or Firm* — Gary R. Maze; Berenbaum Weinshienk, PC

(57) ABSTRACT

A tubular clamp for gripping a tubular is disclosed. In one aspect, a tubular clamp for use with a cutting and lifting system is provided. The tubular clamp is configured to move between an opened position and a closed position. The tubular clamp further includes at least one slip member to permit the clamp to bear the weight of a severed tubular string. Lifting lugs on an outer surface of the clamp permit attachment to a lifting assembly.

14 Claims, 5 Drawing Sheets

(56) References Cited

U.S. PATENT DOCUMENTS

2006/0108122 A1* 5/2006 Buytaert et al. ..... 166/379
2009/0308605 A1* 12/2009 McAfee et al. ..... 166/255.1
2010/0038080 A1* 2/2010 McAfee et al. ..... 166/255.1
2011/0132594 A1* 6/2011 Slack ..... 166/77.51
2011/0209872 A1* 9/2011 McAfee et al. ..... 166/298
2012/0145405 A1* 6/2012 Vanderford et al. ..... 166/341

* cited by examiner

CLAMP FOR A WELL TUBULAR

BACKGROUND OF THE INVENTION

1. Field of the Invention

Embodiments of the present invention generally relate to an apparatus and a method for use in abandonment of oil and gas wells. More particularly, embodiments of the invention relate to removal of well tubulars using a clamp for use with a cutting system on an offshore platform.

2. Description of the Related Art

After a well has depleted its particular pay zone of oil and/or gas, the well will typically be decommissioned. Decommissioning includes a number of activities, all designed to ensure the used well does not create environmental and safety concerns after its useful life is over. For example, lined wellbores extending into the earth are typically plugged with cement at various locations along their length to prevent the migration of remaining hydrocarbons to the surface where they could escape into the environment. In addition to plugging activities, equipment at or near the surface must be securely removed, and this is especially important for equipment related to offshore wells.

Offshore platforms, formed from a combination of steel and concrete, include legs that extend to and into the seabed. These immobile structures are designed to help drill the wells and typically remain in place over producing wells to facilitate the gathering of oil and gas. When the well's production is complete, the platforms are moved to another location or disassembled.

In addition to the platforms themselves, strings of tubulars extend from the platform floor down to the seabed providing a communication path for oil and gas from the subsea wellbore to the platform. In some cases, a single platform serves a number of subsea wellbores, each with its own tubular string extending upwards to the platform floor. When a well is decommissioned, these tubulars extending from the wellbore must also be removed, typically by severing them at some depth below the seabed. Each string of tubulars can include multiple strings of differing diameters, each housed within the next with an annular area formed therebetween. A conductor is usually the largest diameter tubular in a well, and its purpose is to prevent the soft formations near the surface from caving in and to conduct drilling mud from the bottom of the hole to the surface when drilling starts. Smaller tubular strings within the conductor include casing and production tubing. These smaller diameter strings can also extend to the platform and need removal. In some instances smaller tubulars are grouted, or cemented in the larger conductor string whereby the annuli is filled with cement-like substances. In other instances the tubular strings within the conductor are not grouted and are therefore independent of each other.

Tubular removal can be carried out with mechanical or abrasive tools and methods. Mechanical cutting devices include cutters or knives disposed on a tool that is run into the tubular string on a work string to a depth where cutting is to take place. The tool is actuated, usually by rotation, and a wall of the tubular is destroyed as the cutters separate the tubular into an upper and a lower portion. Thereafter the tool is removed and the severed portion of tubular string is pulled up to the platform or a vessel, usually with the help of a crane or some type of jack.

Other cutting means include abrasive water jet cutting. An abrasive water jet cutter is also operated from inside a tubular string and severs the tubular by penetrating the wall with high-energy, high-velocity abrasive-filled water. Abrasive water jet cutters are especially effective for cutting multiple strings of tubulars in one operation, like successively smaller strings within a conductor. U.S. Pat. No. 7,178,598 entitled "Device for a Hydraulic Cutting Tool" and assigned to the assignee of the present invention, describes a method and apparatus for severing or cutting a tubular at a location below the seabed, and that patent is incorporated herein in its entirety.

Unlike mechanical cutting, abrasive water jet cutting produces a very "clean" cut, removing very little material from the tubular wall as the cut is made. Because so little material is removed, there is very little movement of the tubular string at the surface and often no way to be certain that the cut has been completed and the tubular severed. For this reason, abrasive water jet cuts are "proven" by lifting the upper portion of the tubular at least several inches to demonstrate its readiness for hoisting to the platform floor. To quickly and easily prove the cut, a typical jet cutting assembly includes a pair of cylinders that pull upwards on the tubular after the cut is made. If the tubular has been successfully cut, the upper portion will move upwards to prove the cut. If not, the cutting apparatus (which is still in tubular) is once again operated until the cut can be successfully proven. In the case of multiple tubular strings, an operator knows the cut is successful and all tubulars have been cut if the outer conductor is liftable. Once the cut has been proven, the cutting assembly is relocated to another conductor on the platform or to another job. A large-capacity crane, typically on a derrick barge, collects the severed strings for disposal.

One time-consuming aspect of proving abrasive water jet cuts on offshore tubulars involves the connection means needed between the lifting cylinders and an upper end of the tubular. Currently, lifting lugs are welded onto opposite sides of the tubular wall prior to the cutting operation to provide a lifting connection. The lifting lugs are necessary because without them there would be no way to effectively connect the tubular to the lifting cylinders so that its weight can be borne in the proving process. While the lifting lugs are effective, their installation requires time and a skilled worker's attendance on the platform and requires welding or other hot work that is considered a dangerous activity, even on a non-producing well. Further the welded lifting lugs are permanently installed, and their location on the tubular cannot be changed or adjusted in the event that the lugs are needed in a different rotational or axial location on the tubular.

Therefore, there is a need for a simple, flexible and cost-effective apparatus and method for making a temporary attachment to tubulars for proving an abrasive water jet cut.

SUMMARY OF THE INVENTION

The present invention generally relates to an apparatus and method for proving a severed well tubular. In one aspect the cutting is done in a well decommissioning procedure and is performed at a location below the seabed of a well by an abrasive water jet cutter. In one aspect, a mechanical clamp is disposed on an upper portion of the tubular. The clamp has lifting lugs on its outer surface for connection to a lifting apparatus and the clamp has slip members on its inner diameter, thereby permitting the clamp to bear the weight of the tubular so that it can be lifted at least far enough to prove the cut.

In another aspect, a method of using a tubular clamp in a system that includes a cutting tool and a lifting assembly is provided. The method includes the step of opening the tubular clamp and placing the tubular clamp around a tubular. The method further includes the step of closing the tubular clamp around the tubular. The method also includes the step of connecting the tubular clamp to the lifting assembly. Additionally, the method includes the step of pulling on the tubular clamp using the lifting assembly after the cutting tool cuts the tubular. In another aspect, the clamp is opened, repositioned and closed again at another axially and/or rotationally distinct location on the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an offshore rig or platform in a decommissioning operation. The tubular clamp is used with a cutting system typically on an offshore platform. The cutting system is configured to cut the tubular and then lift an upper portion of the tubular to prove or verify the cut. In the description that follows, like parts are marked throughout the specification and drawings with the same number indicator. The drawings may be, but are not necessarily to scale, and the proportions of certain parts have been exaggerated to better illustrate details and features of the invention. To better understand the aspects of the present invention and the methods of use thereof, reference is hereafter made to the accompanying drawings.

Figure 1:
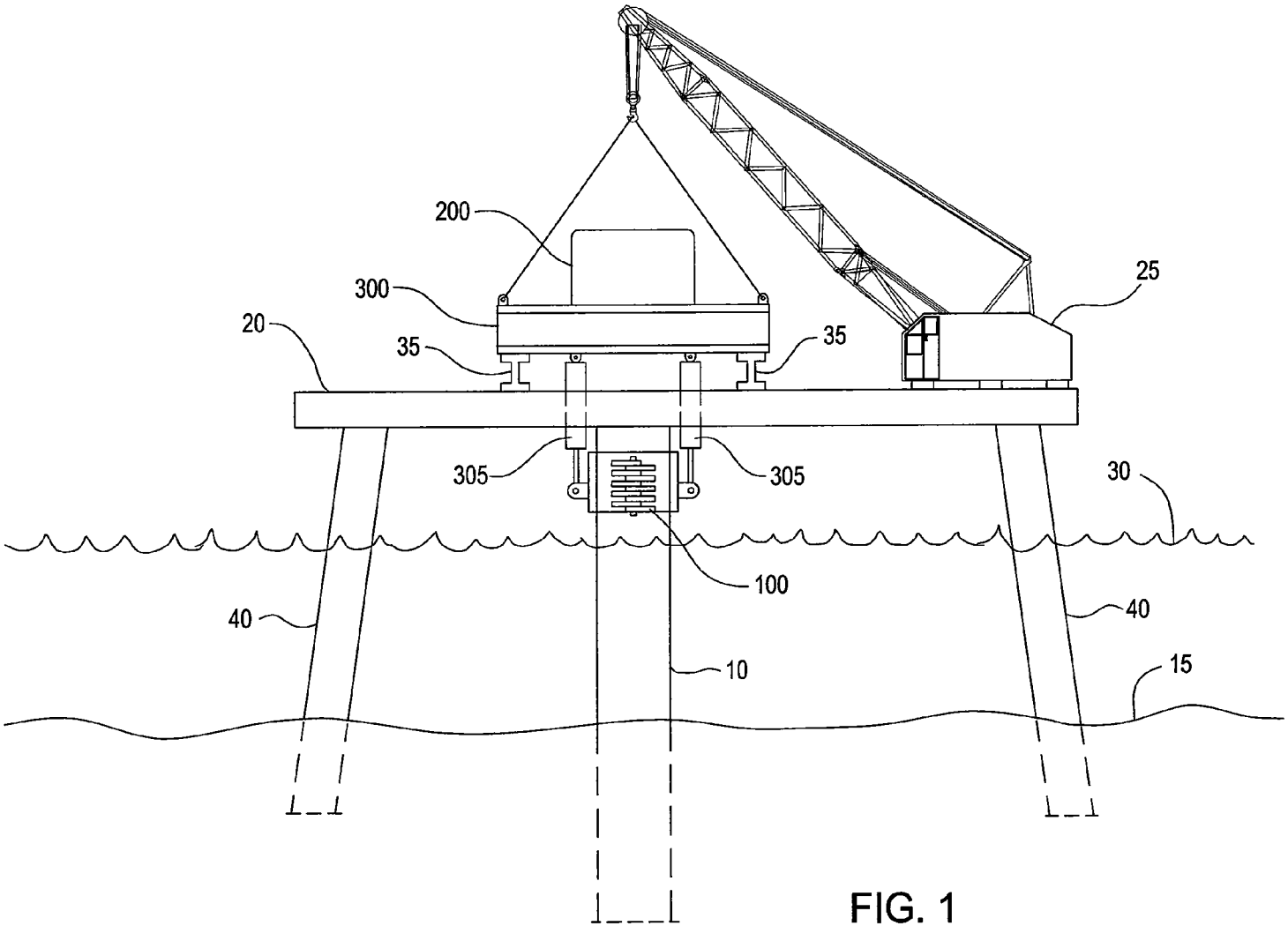
FIG. 1 illustrates a tubular clamp on a cutting and lifting system.

FIG. 1 is a view that illustrates a tubular clamp 100 on a cutting and lifting system 300 that is lowered on a platform 20 by a crane 25. The platform 20 is connected to a well by a tubular 10 (i.e., conductor or casing). The platform 20 is supported above the water 30 by a plurality of supports 40 that extend into the seabed 15. A tubular clamp 100 (more completely discussed with reference to FIGS. 4-6) is shown attached to the tubular 10. Generally, the tubular clamp 100 is a selectively actuated griping member that is configured to grip an outer surface of the tubular 10 and then be gripped itself using lifting lugs formed on its outer surface.

The cutting and lifting system 300 includes a cutting assembly 200 that is used to cut the tubular 10 (FIG. 2) at a location below the seabed. The system further includes a lifting assembly 305, such as hydraulic cylinders. The lifting assembly 305 is connected to the tubular clamp 100 via lifting lugs 105 and then activated at a predetermined time to lift the tubular 10 and the clamp 100 a short distance (FIG. 3).

Figure 2:
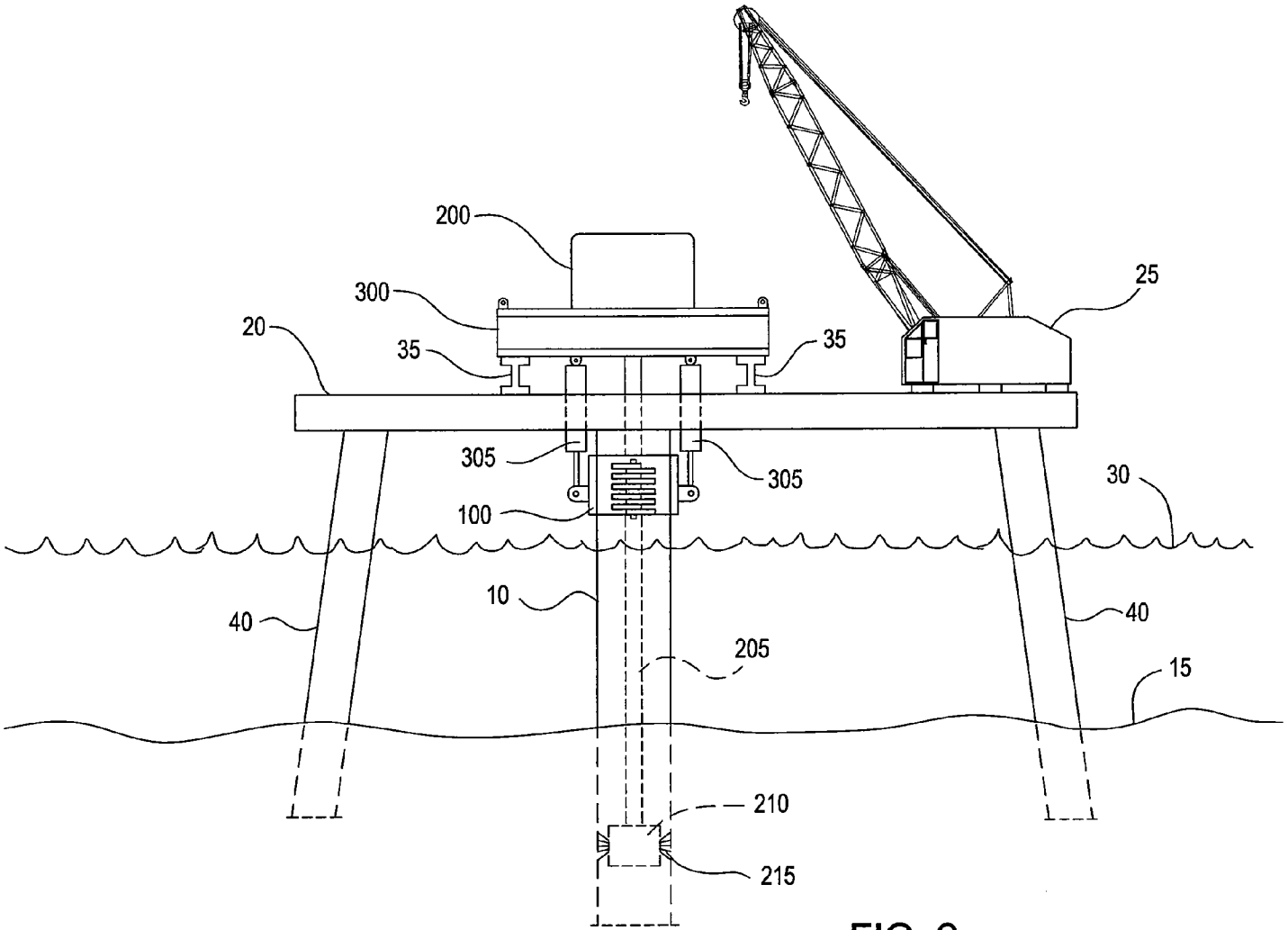
FIG. 2 illustrates the tubular clamp attached to a tubular as the cutting and lifting system cuts the tubular.

FIG. 2 illustrates a cutting tool 210 in the cutting assembly 200 performing a cutting operation on the tubular 10. After the cutting and lifting system 300 is positioned on the rig 20, the cutting tool 210 is lowered into the tubular 10 using a conveyance member 205, such as a cable or a hose. The cutting tool 210 may be any type of cutting tool capable of cutting the tubular 10, such as an abrasive water jet tool, a mechanical cutting tool, or an explosive cutting tool. Typically, the cutting tool 210 is lowered to a predetermined point into the tubular 10 (in one instance to a location 15 feet below the seabed 15). Thereafter, the cutting tool 210 is activated to cut the tubular 10. In the embodiment shown, the cutting tool 210 uses abrasive water 215 to cut the tubular 10 from the inside of the tubular. While only a single tubular is shown in FIGS. 1-3, it will be understood that there can be several tubular strings housed in a single outer tubular string, and the invention is equally usable with any arrangement.

Figure 3:
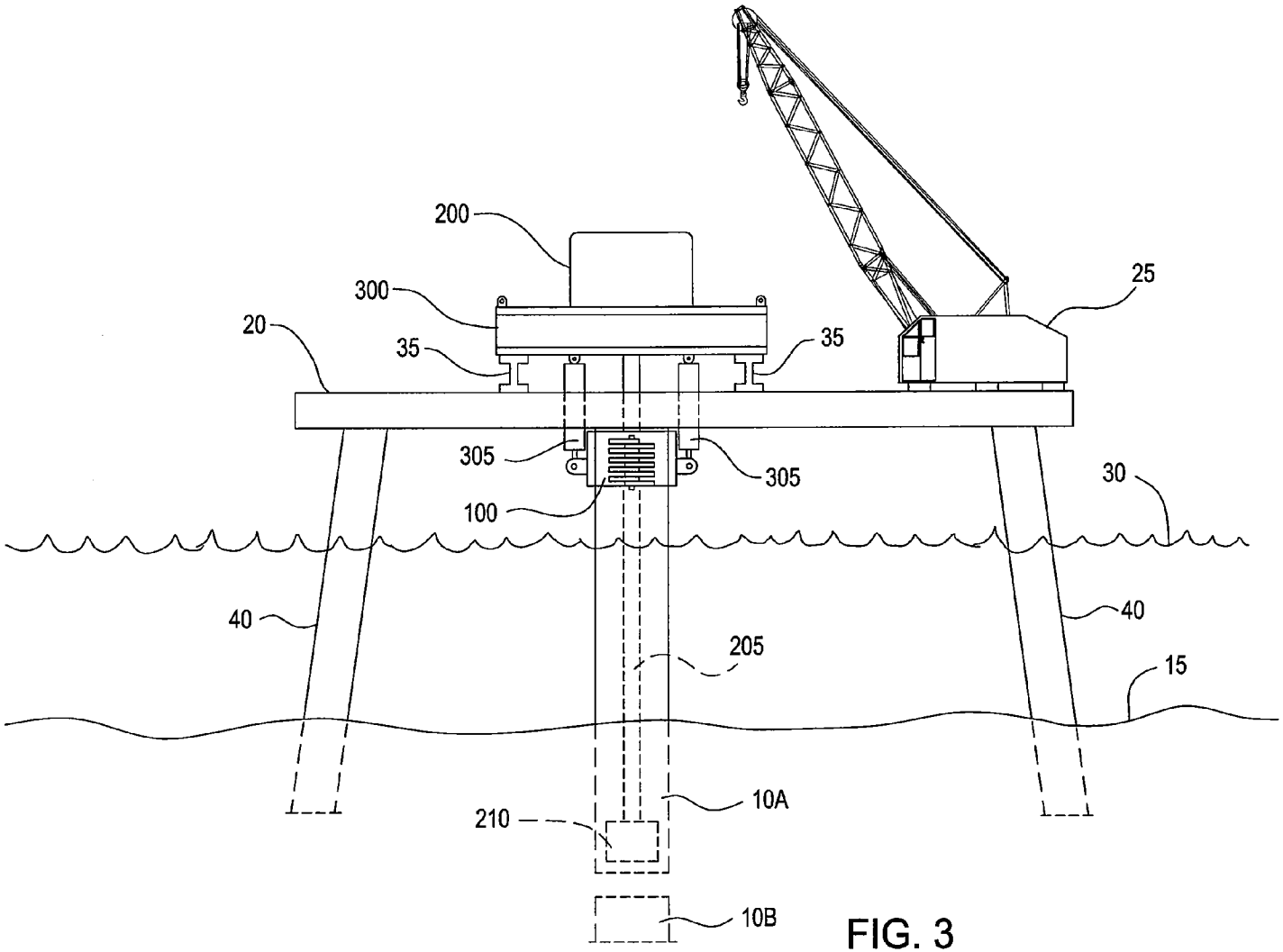
FIG. 3 illustrates a lifting assembly of the cutting and lifting system pulling on the tubular clamp.

FIG. 3 illustrates the activation of the lifting assembly 305 of the cutting and lifting system 300. After the cutting tool 210 performs the cutting operation, the lifting assembly 305 is used to verify that the cut was successful by pulling on the tubular clamp 100 attached to an upper (severed) portion 10A of the tubular 10. Generally, the rods of the hydraulic cylinders in the lifting assembly 305 are retracted, thereby creating a pulling force on the tubular clamp 100. If the cut was successful, then the tubular clamp 100 with the upper portion 10A of the tubular 10 is raised a predetermined distance relative to a lower portion 10B of the tubular 10. In other words, if the upper portion 10A of the tubular 10 is able to be raised relative to the lower portion 10B of the tubular 10 that extends from the wellbore, then the tubular 10 (and any other tubular strings housed within it) has been successfully cut. If the upper portion 10A of the tubular 10 is not movable, then it is still connected to the lower portion 10B of the tubular 10 and another cutting operation is performed by the cutting tool 210. After the cut of the tubular 10 has been verified, the upper portion 10A of the tubular 10 is lowered by the lifting assembly 305.

Thereafter, the cutting tool 210 is retrieved from inside the tubular 10, and the tubular clamp 100 is released from the upper portion 10A of the tubular 10. At this time, the cutting and lifting system 300 may be removed from the rig 10 or to some other location on the rig to perform a cut on another tubular. The severed tubular will typically be lifted onto the platform and cut into pieces and removed by conventional, well known means. Typically, a high-capacity crane is used to lift the severed section at which time a pin can be inserted through the tubing to help hold all the various strings while it is cut into pieces. The tubing clamp 100 can be left in place or reinstalled to permit the crane to initially lift the tubing section to the platform floor.

Figure 4:
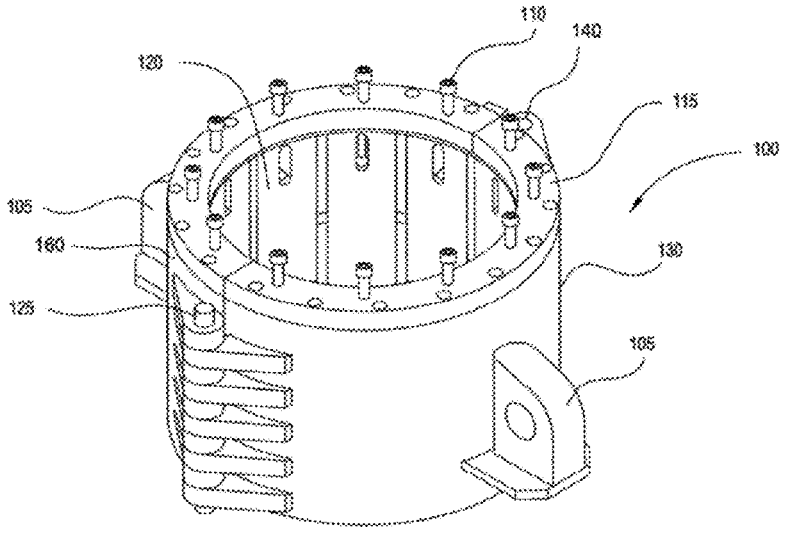
FIG. 4 illustrates a perspective view of the tubular clamp.
Figure 4A:
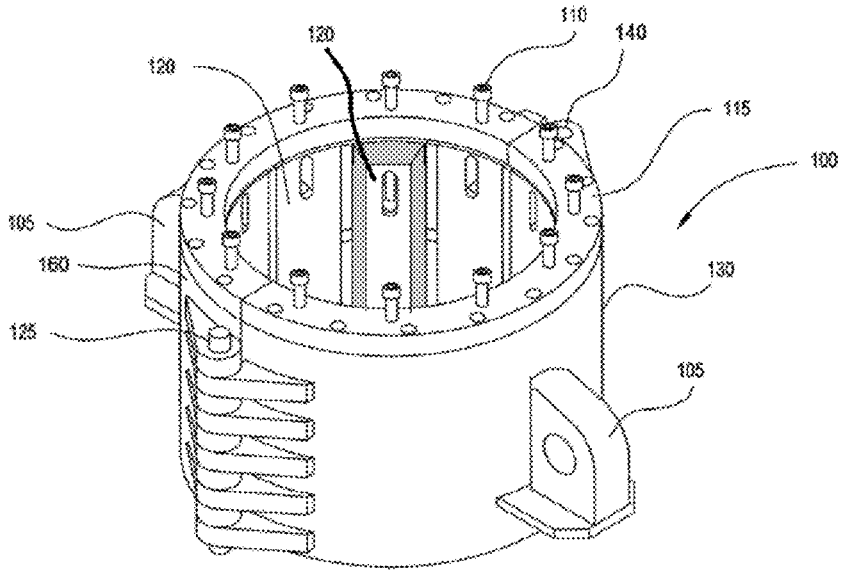
FIG. 4*a* illustrates a perspective view of the tubular clamp with a slip member moving radially inward.

FIG. 4 illustrates a perspective view of the tubular clamp 100. The tubular clamp 100 includes a first door 130 connected to a second door 160 by a pin 125 at one end and a pin 140 at another end. Either or both pins 125, 140 may be selectively removable to allow doors 130, 160 to open. Either or both pins 125, 140 may additionally serve as hinges or locks. The tubular clamp 100 further includes a plurality of slips 120 which are configured to engage the tubular upon activation of the tubular clamp 100. The slips 120 are movable relative to the doors 130, 160 by rotating slip positioning members 110 on plate 115 of each door 130, 160. The tubular clamp 100 also includes lifting lugs 105 attached to each door 130, 160. The lifting lugs 105 are used to connect the tubular clamp 100 to the lifting assembly 305. In another embodiment, eyebolts (not shown) may be attached to the plate 115. The eyebolts are used during the installation operation to move the tubular clamp 100 to the proper location.

Figure 5:
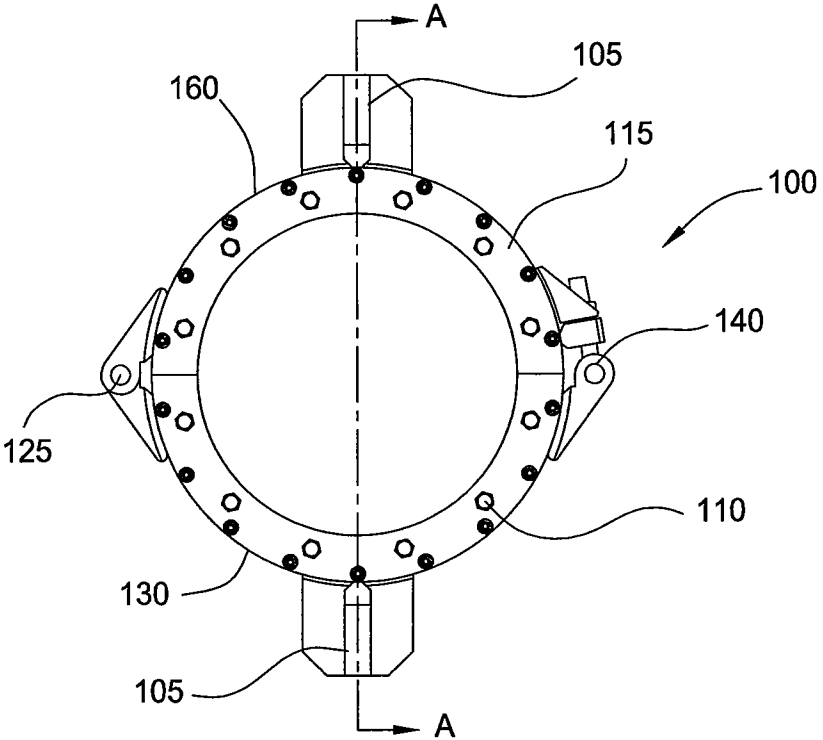
FIG. 5 illustrates a top view of the tubular clamp.

FIG. 5 illustrates a top view of the tubular clamp 100. The tubular clamp 100 is moveable between a closed position, an activated position and an opened position. In the closed position, the tubular clamp 100 is positioned around the tubular (FIG. 2). In the activated position, the slips 120 have moved relative to the doors 130, 160 to allow the tubular clamp 100 to engage the tubular. In the opened position, the doors 130, 160 pivot around the pin 125 in a direction away from each other. The opened position allows the tubular clamp 100 to be released from a tubular and/or engage a tubular. The operation of the tubular clamp 100 may be configured to be controlled by a remote device.

Figure 6:
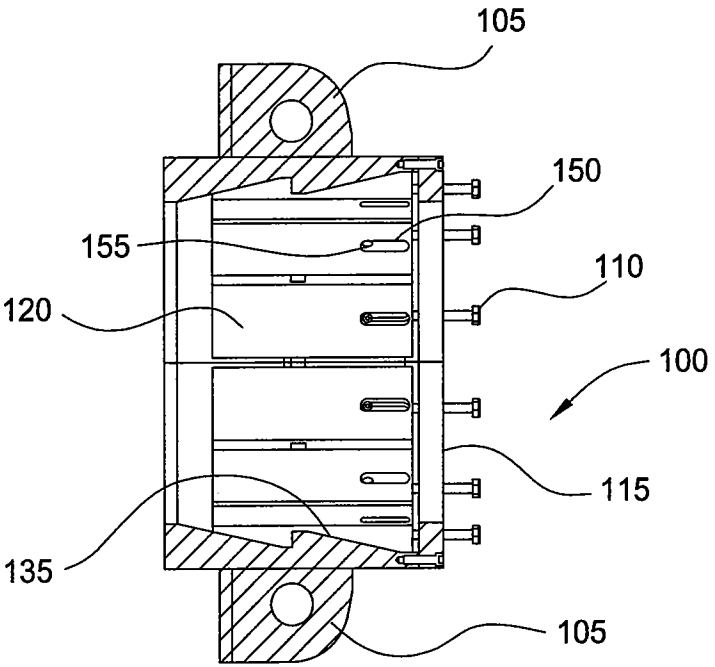
FIG. 6 illustrates a section view of the tubular clamp taken along line A-A of FIG. 5.

FIG. 6 illustrates a section view of the tubular clamp 100. Each slip 120 is moved by rotating a corresponding slip positioning member 110 adjacent a portion of the slip 120. As the slip positioning member 110 is rotated, the slip positioning member 110 causes the slip 120 to move up a ramp 135 on the doors 130, 160. The movement of the slip 120 up the ramp 135 causes the slip 120 to move radially inward and into engagement with the tubular. Further, as the slip 120 moves up the ramp 135, a guide pin 155 on the door 130, 160 guides the movement of the slip 120 as the guide pin 155 interacts with a slot 150 formed in the slip 120. After the slips 120 are activated by the slip positioning members 110, the pulling on the tubular clamp 100 via the lugs 105 (and the lifting assembly 305) causes each slip 120 to further travel up the ramp 135 such that the tubular clamp 100 further engages the tubular. In one embodiment, the tubular clamp 100 includes guide rods (not shown) that are attached to the slips 120. The guide rods are used to move the slips 120 down the ramp 135 during the installation operation, which causes the slips 120 to move radially outward. The movement of the slips 120 radially outward increases the inner diameter of the tubular clamp 100, which allows the tubular clamp 100 to be placed around the tubular. It is to be noted that the tubular clamp 100 may be used with different diameter tubing by simply removing and replacing the slips 120 with other larger (or smaller) slips accordingly, which decreases (or increases) the inner diameter of the tubular clamp 100.

The tubular clamp disclosed herein has significant advantages over the prior art methods of providing a lifting means to a tubular for proving a cut. In addition to eliminating the need for a skilled welder, the clamp is easily installed, adjusted and removed, providing flexibility in the rotational and axial placement of the lifting lugs that is not possible with welded lugs. For example, in one embodiment, the clamp is installed at a location of a tubular later determined to have been weakened due to corrosive wear. Rather than cutting and re-welding the lugs, the clamp can be loosened, moved and retightened in a more appropriate location. In one example, a tubular cut is proven without the cylinders shown in FIGS. 1-3. Instead, the cut is proven using a vessel-mounted crane having two elongated lifting members for attachment to the lifting lugs. Rather than rotating the lifting apparatus to align the lifting members with the lugs, the clamp can simply be loosened and then rotated to align the lifting lugs with the elongated members before re-tightening the clamp.

While the discussion and examples provided herein have dealt primarily with offshore tubulars, the present invention with its methods can be practiced at any location, including land-based wells where tubular strings require cutting and the cut requires proving.

While the foregoing is directed to embodiments of the present invention, other and further embodiments of the invention may be devised without departing from the basic scope thereof, and the scope thereof is determined by the claims that follow.

The invention claimed is:

1. A system for cutting a tubular extending from a subsea wellbore, the system comprising:

a. a cutting assembly configured to cut the tubular at an underground location;

b. a selectively actuated grip member configured to grip an outer surface of the tubular, the grip member comprising a first door and a second door, the first door and the second door being movable between an opened position and a closed position, and a plurality of slip positioning members radially movable towards a center of the grip member and adapted to engage the tubular upon activation of the grip member; and c. a lifting assembly disposed above and connected to the grip member, wherein the lifting assembly is configured to lift the grip member and a portion of the tubular relative to the cutting assembly after the tubular has been cut.

2. The system of claim 1, wherein the first door is selectively connected to the second door.

3. The system of claim 2, wherein each door includes at least one slip member that moves radially inward as the at least one slip member moves along a ramp formed in the door.

4. The system of claim 3, wherein the grip member further includes at least one slip positioning member configured to move the slip a predetermined distance along the ramp of the door.

5. The system of claim 1, wherein the cutting assembly includes a cutting tool disposed on a conveyance member.

6. The system of claim 5, wherein the cutting tool is lowered into the tubular using the conveyance member to a predetermined location and then selectively activated to cut the tubular.

7. The system of claim 5, wherein the cutting tool cuts the tubular by using an abrasive water jet.

8. The system of claim 1, wherein the lifting assembly comprises a plurality of hydraulic cylinder members, a predetermined number of the plurality of cylinder members connected to and selectively retractable with respect to the grip member.

9. The system of claim 1, wherein the lifting assembly includes a crane.

10. A method of cutting a tubular extending from a subsea wellbore, comprising:

a. positioning a cutting and lifting system on a rig floor above the wellbore;

b. gripping an outside surface of an upper portion of the tubular with a selectively actuated clamp, the clamp having at least one attachment member on an outer surface thereof, the clamp comprising a first door and a second door, the first door and the second door being movable between an opened position and a closed position and a plurality of slip positioning members radially movable towards a center of the clamp and adapted to engage the tubular upon activation of the clamp, each door comprising a plate in contact with and corresponding to a respective one of the plurality of slip position members;

c. inserting a cutting tool into the tubular to a predetermined point in the wellbore;

d. cutting the tubular, thereby separating the tubular into a lower portion and a separated, upper portion;

e. moving the slips relative to the doors by rotating each slip positioning member on its corresponding plate; and f. lifting the clamped upper portion of the tubular relative to the lower portion of the tubular to confirm separation.

11. The method of claim 10, further comprising attaching the cutting and lifting system to the at least one attachment member of the clamp.

12. The method of claim 10, further comprising lowering the upper portion of the tubular after separation is confirmed.

13. The method of claim 12, further comprising releasing the grip on the outside surface of the upper portion of the tubular.

14. The method of claim 13, further comprising removing the cutting and lifting system from the rig.

* * * * *